US005580340A

United States Patent [19]

Yu

[11] Patent Number: 5,580,340

[45] Date of Patent: Dec. 3, 1996

[54] MULTI-FUNCTIONAL EXERCISER

[76] Inventor: Chih-An Yu, P.O. Box 82-144, Taipei, Taiwan

[21] Appl. No.: 575,572

[22] Filed: Dec. 20, 1995

[51] Int. Cl.[6] ..... A63B 21/00

[52] U.S. Cl. ..... 482/96; 482/95; 482/72

[58] Field of Search ..... 482/72, 96, 10, 482/57, 111, 148, 106, 110, 51

[56] References Cited

U.S. PATENT DOCUMENTS

| | | | |
|---|---|---|---|
| 2,924,456 | 2/1960 | Miller | 482/96 |
| 4,743,010 | 5/1988 | Geraci | 482/72 |
| 5,366,428 | 11/1995 | Liao | 482/57 |
| 5,429,568 | 7/1995 | Chen | 482/96 |
| 5,464,378 | 11/1995 | Yu | 482/95 |

*Primary Examiner*—Jerome Donnelly
*Attorney, Agent, or Firm*—Alfred Lei

[57] ABSTRACT

A multi-functional exerciser including a base including a front rod, a rear rod and an intermediate rod mounted between the front rod and the rear rod, a generally inverted U-shaped slide slidably mounted on the intermediate rod and provided at both sides thereof with a roller engaged with the groove of the intermediate rod, a seat assembly including a pair of first supporting rods pivotally connected with the second bracket, a seat fixedly mounted on the supporting rods, and a rotating rod pivotally connected at a lower end thereof with the third bracket and provided at a bottom with a fourth bracket, a pair of resilient members mounted between the first supporting rods and the slide, a backrest assembly including a second supporting rod, a backrest fixedly mounted on an upper portion of the second supporting rod, and a second rotating rod pivotally connected at a lower end thereof with the fifth bracket and at an upper end thereof with an upper end of the second supporting rod, and a footrest assembly including a third rotating rod, a sixth bracket movably mounted on the third rotating rod, and a telescopic rod having an end thereof pivotally connected with the sixth bracket and another end thereof pivotally connected with the fifth bracket.

1 Claim, 4 Drawing Sheets

MULTI-FUNCTIONAL EXERCISER

CROSS REFERENCE TO RELATED APPLICATIONS

This application is based on provisional application Ser. No. 60/001,546 filed on Jul. 27, 1995.

BACKGROUND OF THE INVENTION

1. Field of the Invention

This invention relates to a multi-functional exerciser.

2. Description of the Prior Art

It has been found that the conventional exercise apparatus has only one purpose, i.e. exercising legs, chest, back arms, or shoulders. Hence, it is necessary for one to buy a number of exercise apparatuses in order to have exercise of different muscle groups. Thus, a so-called universal gym has been developed to obviate this drawback. However, the conventional universal gym is too bulky in size and expensive in cost thereby rendering it unsuitable for use in ordinary homes.

Therefore, it is an object of the present invention to provide a multi-functional exerciser which can obviate and mitigate the above-mentioned drawbacks.

SUMMARY OF THE INVENTION

This invention relates to a multi-functional exerciser.

It is the primary object of the present invention to provide a multi-functional exerciser which can be used for exercising the hands, feet, lumbar and back of a user simultaneously.

It is still another object of the present invention to provide a multi-functional exerciser which is convenient to use.

It is still another object of the present invention to provide a multi-functional exerciser which is easy to manufacture.

It is still another object of the present invention to provide a multi-functional exerciser which can be placed at the market at a relatively low cost.

It is a further object of the present invention to provide a multi-functional exerciser which is fit for practical use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
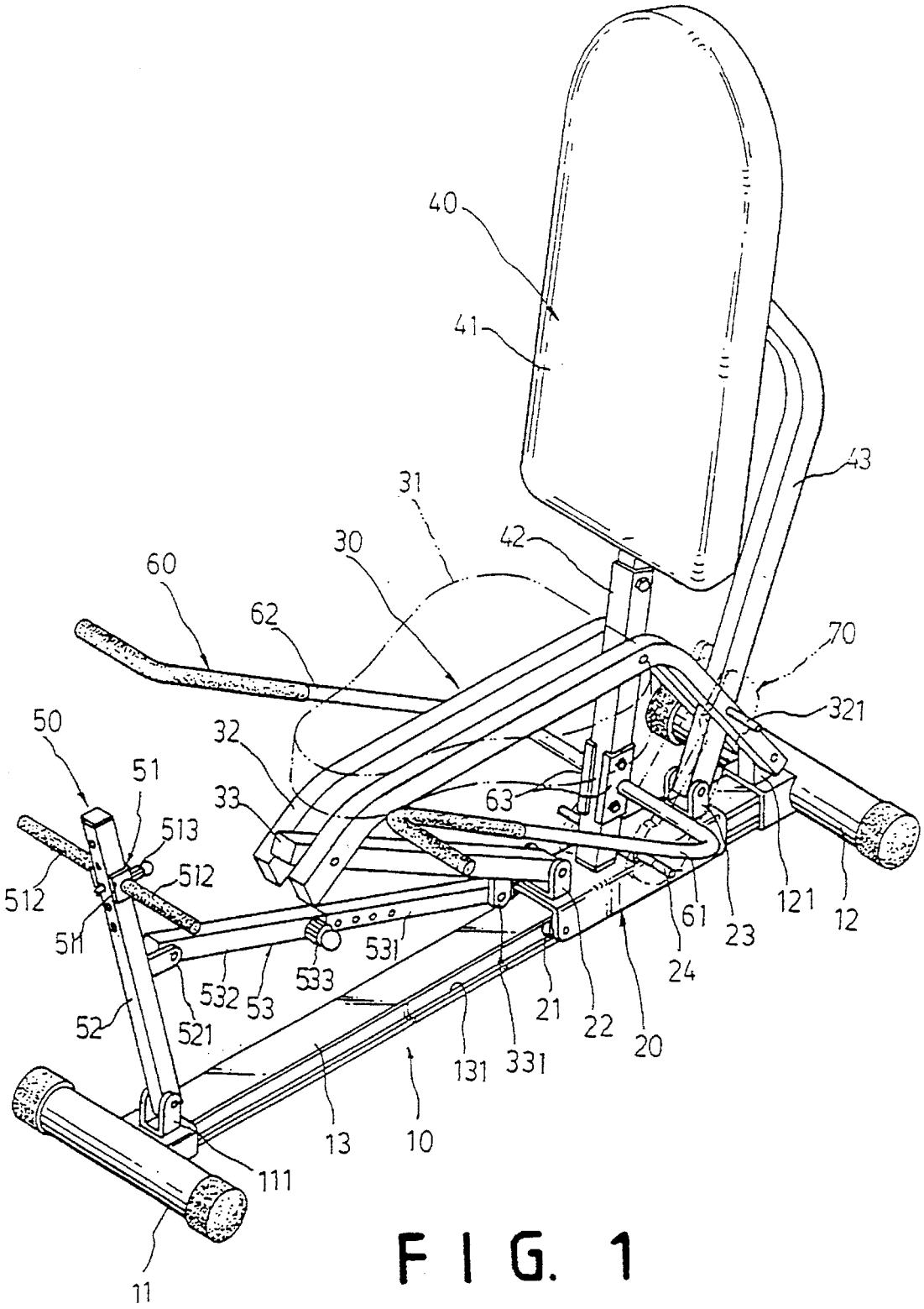
FIG. 1 is a perspective view of the present invention.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
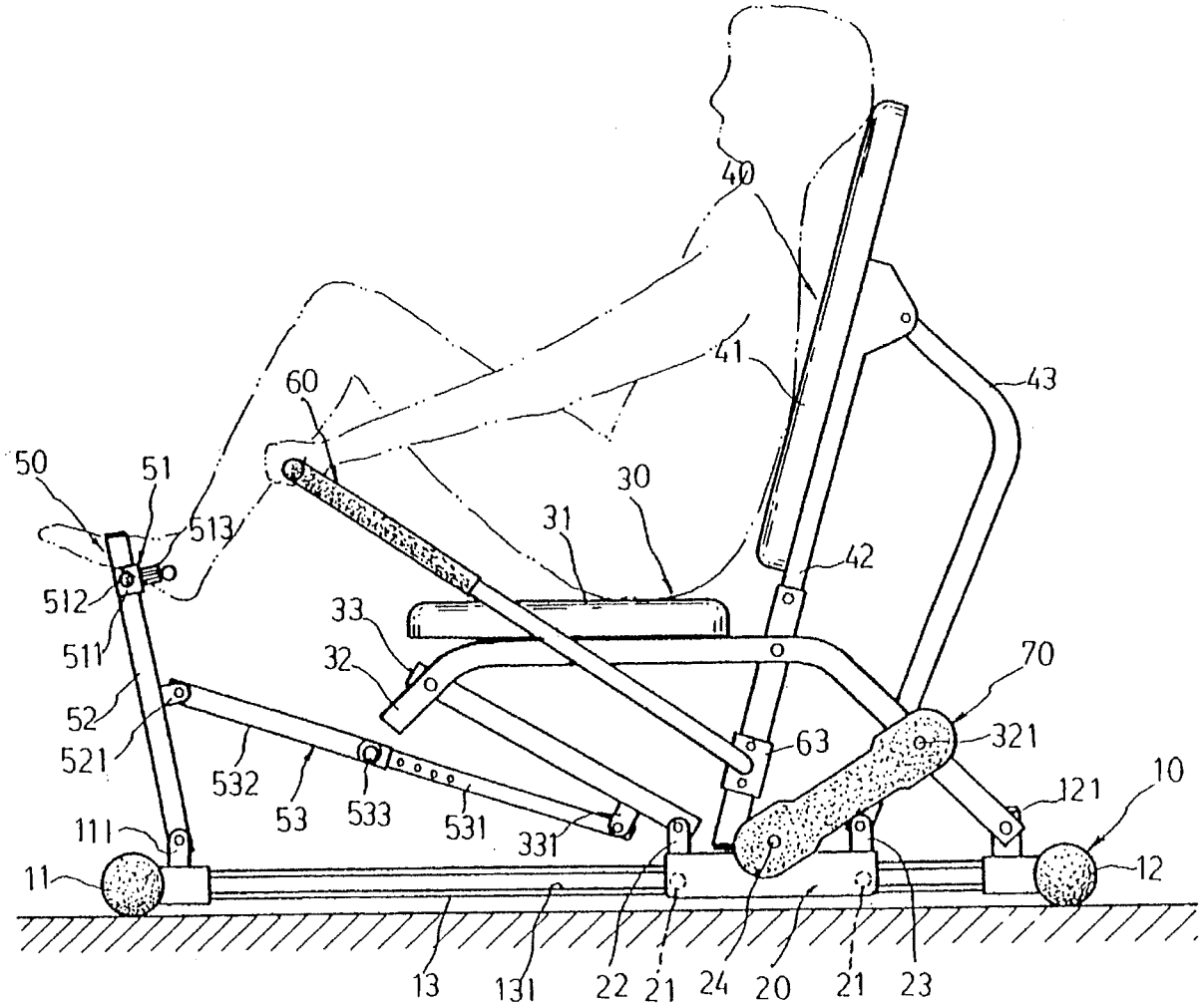
FIGS. 2 and 3 illustrate the working principle of the present invention.

With reference to the drawings and in particular to FIGS. 1 and 2 thereof, the multi-functional exerciser according to the present invention mainly comprises a base 10, a slide 20, a seat assembly 30, a backrest assembly 40, a footrest assembly 50, a handle assembly 60 and a pair of resilient members 70.

The base 10 includes a front rod 11, a rear rod 12 and an intermediate rod 13 mounted between the front rod 11 and the rear rod 12 which are respective provided with brackets 111 and 121. The intermediate rod 13 is formed with a groove 131 at both sides. The slide 20 is a generally inverted U-shaped member having two legs each provided with a roller 21 at the inner side adapted to engage with the groove 131 of the intermediate rod 13 so that the slide 20 may be moved along the intermediate rod 13. The slide 20 is provided with brackets 22 and 23 at both ends and a rod 24 at the intermediate portion.

The seat assembly 30 includes a seat 31, a pair of supporting rods 32, and a rotating rod 33 pivotally connected between the supporting rods 32. The supporting rod 32 is a generally inverted U-shaped member having its one end pivotally connected with the bracket 121 and its the another end pivotally connected with the rotating rod 33. The resilient members 70, which are preferably made of rubber, are mounted on the supporting rod 32 at one end by a pin 321 and on the slide 20 by the rod 24 at another end. The lower end of the rotating rod 33 is pivotally connected with the bracket 22 of the slide 20. The rotating rod 33 is provided at the bottom side with a bracket 331. The seat 31 is fixedly mounted on the horizontal portion of the supporting rods 32.

The backrest assembly 40 includes a backrest 41, a supporting rod 42 and a rotating rod 43. The supporting rod 42 and the rotating rod 43 of the backrest assembly are fitted between the two supporting rods 32 of the seat assembly 30. The supporting rod 42 is pivotally connected with the rear part of the horizontal portion of the supporting rods 32. The upper end of the rotating rod 43 is pivotally connected with an upper end of the supporting rod 42. The lower end of the rotating rod 43 is pivotally connected with the bracket 23 of the slide 20. The backrest 41 is fixedly mounted on the upper portion of the supporting rod 42.

The footrest assembly 50 includes a bracket 51, a rotating rod 52 and an adjusting rod 53. The lower end of the rotating rod 52 is pivotally connected with the bracket 111 of the base 10. The upper portion of the rotating rod 52 is formed with a plurality of holes. The intermediate portion of the rotating rod 52 is provided with a bracket 51. The bracket 521 includes a U-shaped member 511 on each of which is mounted a rod 512 for supporting a foot. The bracket 51 is connected with the rotating rod 52 by an engaging pin 513 extending through the bracket 51 and the rotating rod 52. The adjusting rod 53 is composed of an inner rod 531 and an-outer rod 532 which are telescopically connected together by an engaging pin 533. The inner rod 531 is pivotally connected with the bracket 331 of the rotating rod 33 at the outer end, while the outer rod 532 is pivotally connected with the bracket 521 of the rotating rod 52, The handle assembly 60 includes a generally U-shaped member having a pair of side rods 61 and 62. The handle handle assembly 60 is pivotal with the supporting rod 42 and kept in place by brackets 63. Each of the resilient members

70 is mounted on the outer side of one of the supporting rods 32 by a pin 321 at one end and mounted on the slide 20 by the rod 24 at the other end.

Figure 3:
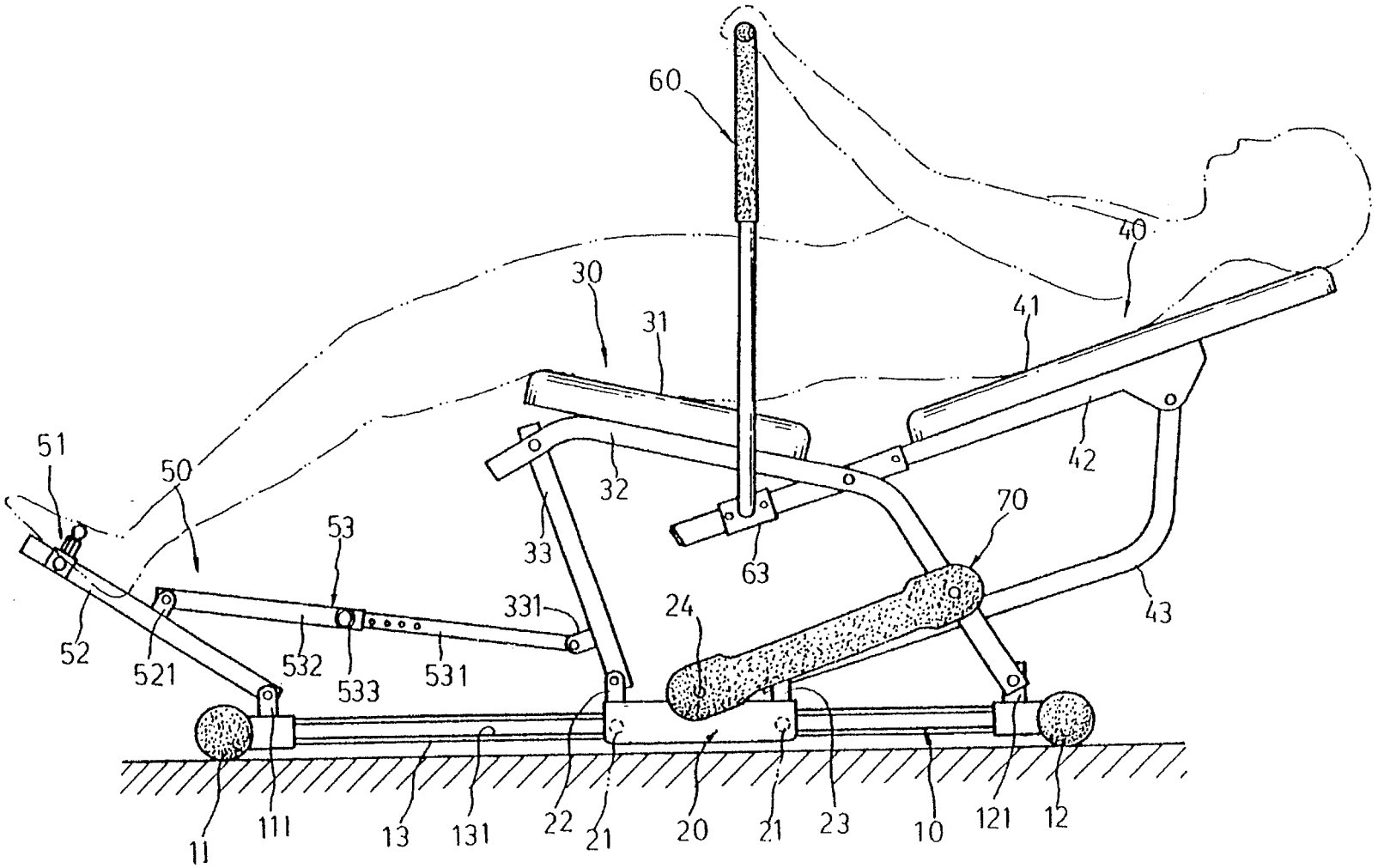

When in use, the user first sits on the seat 31 with his two hands holding the grips of the handle 60 and feet supported on the rods 512. Then, the user pulls the handle 60 backward with his hands and push the footrest assembly 50 forward with his feet against the resiliency of the resilent members 70 thereby exercising his hands, feet, lumbar and back (see FIGS. 3 and 4) simultaneously.

Figure 4:
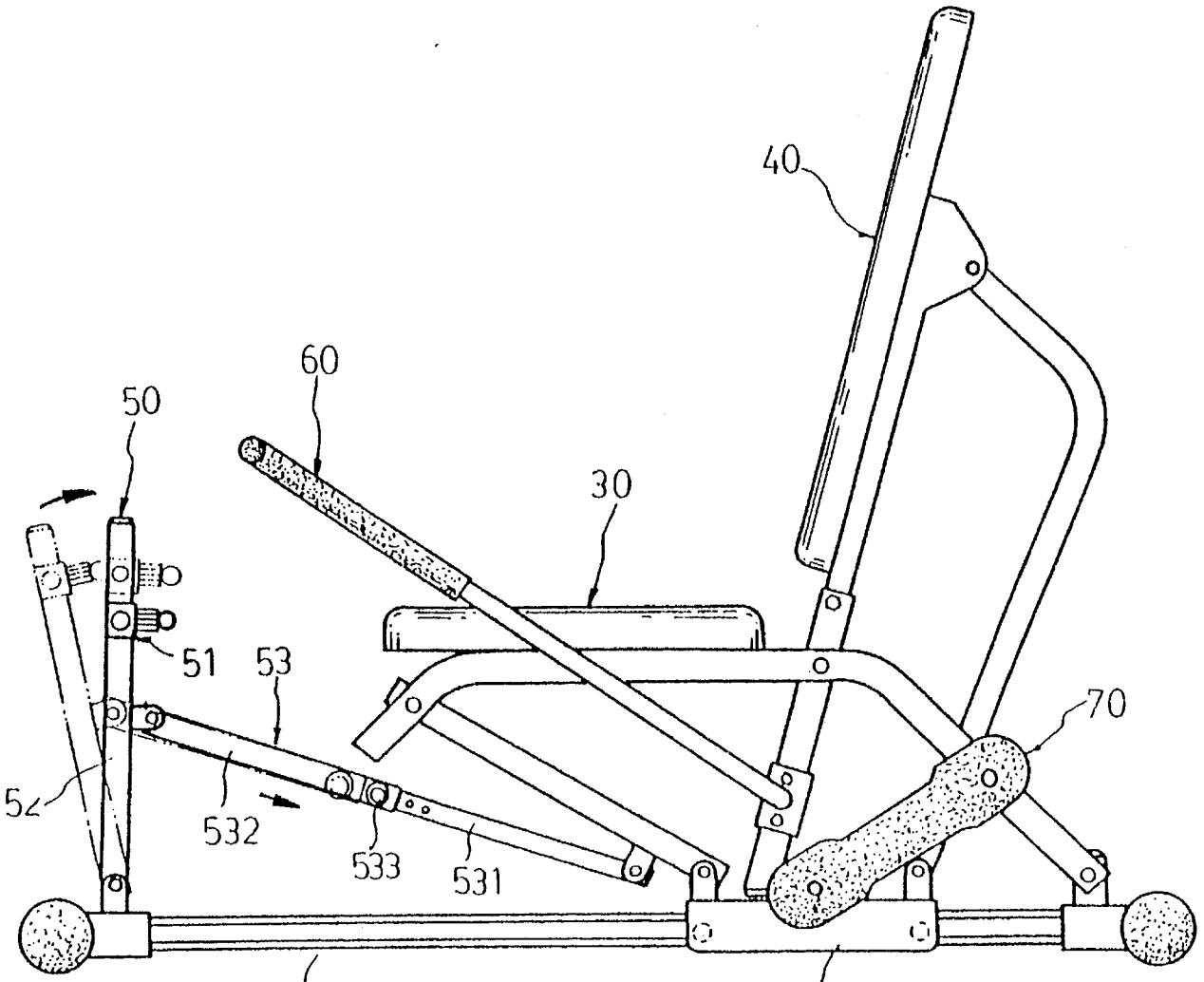
FIG. 4 illustrates how to adjust the position of the footrest.

FIG. 4 illustrates how to adjust the position of footrest assembly 50. As shown, the height of the rods 512 may be adjusted by changing the position of the bracket 511, while the footrest assembly 50 may be moved closer to the user by moving the outer rod 532 into the inner rod 531.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A multi-functional exerciser comprising:

a base including a front rod, a rear rod and an intermediate rod mounted between said front rod and said rear rod, said front rod and said rear rod being respectively provided with first and second brackets, said intermediate rod being formed with a-groove at both sides thereof;

a generally inverted U-shaped slide slidably mounted on said intermediate rod and provided at both sides thereof with a roller engaged with said groove of said intermediate rod, said slide being provided with a third bracket at a front side thereof and a fourth bracket at a rear side thereof;

a seat assembly including a pair of first supporting rods pivotally connected with said second bracket, a seat fixedly mounted on said first supporting rods, and a rotating rod pivotally connected at a lower end thereof with said third bracket and provided at a bottom with a fifth bracket, said rotating rod being connected to said first supporting rods;

a pair of resilient members mounted between said first supporting rods and said slide;

a backrest assembly including a second supporting rod pivotally connected with said first supporting rods, a backrest fixedly mounted on an upper portion of said second supporting rod, and a second rotating rod pivotally connected at a lower end thereof with said fourth bracket and at an upper end thereof with an upper end of said second supporting rod; and a footrest assembly including a third rotating rod, a sixth bracket mounted on said third rotating rod, and a telescopic rod having an end thereof pivotally connected with said sixth bracket and another end thereof pivotally connected with said fifth bracket.

* * * * *